US012571188B2

(12) United States Patent
Geue et al.

(10) Patent No.: US 12,571,188 B2
(45) Date of Patent: Mar. 10, 2026

(54) SYSTEM FOR REMOTE CONTROL OPERATION OF HYDRANT

(71) Applicant: Semperfire, LLC, Sharpsburg, GA (US)

(72) Inventors: Andrew Geue, Rio, WI (US); Dennis Borde, Rio, WI (US)

(73) Assignee: Semperfire, LLC, Sharpsburg, GA (US)

( * ) Notice: Subject to any disclaimer, the term of this patent is extended or adjusted under 35 U.S.C. 154(b) by 0 days.

(21) Appl. No.: 18/642,494

(22) Filed: Apr. 22, 2024

(65) Prior Publication Data

US 2024/0352715 A1 Oct. 24, 2024

Related U.S. Application Data

(60) Provisional application No. 63/497,397, filed on Apr. 20, 2023.

(51) Int. Cl.
*E03B 9/10* (2006.01)
*E03B 9/08* (2006.01)

(52) U.S. Cl.
CPC . *E03B 9/10* (2013.01); *E03B 9/08* (2013.01)

(58) Field of Classification Search
CPC ..... E03B 9/04; E03B 9/08; E03B 9/10
See application file for complete search history.

(56) References Cited

U.S. PATENT DOCUMENTS

| | | | | |
|---|---|---|---|---|
| 4,561,459 | A * | 12/1985 | Jackman | E03B 9/04 251/151 |
| 6,688,326 | B1 * | 2/2004 | Sigelakis | F16K 35/10 137/15.02 |
| 7,083,158 | B1 * | 8/2006 | Burt | E03B 7/08 251/304 |
| 9,670,652 | B2 * | 6/2017 | Schirado | E03B 9/04 |
| 12,038,306 | B2 * | 7/2024 | Smith | E03B 9/04 |
| 2008/0149180 | A1 * | 6/2008 | Parris | F16K 27/12 700/282 |
| 2013/0314239 | A1 * | 11/2013 | Clark | E03B 7/08 340/686.1 |

* cited by examiner

*Primary Examiner* — Kevin F Murphy
(74) *Attorney, Agent, or Firm* — Kern Kendrick, LLC; Thomas Y. Kendrick

(57) ABSTRACT

In one aspect, a system for remote control operation of a hydrant is provided, comprising: a hydrant, comprising: a barrel; a bonnet containing one or more outlet; a flange including a plurality of flange bolts; and an operating nut oriented at the top of the hydrant; and a remote system, comprising: a battery; a gearbox including an electric motor and an operating nut socket engaging the operating nut; a receiver/transmitter electrically connected to the battery and the electric motor; and at least one flange bolt engagement member engaging at least one flange bolt.

15 Claims, 13 Drawing Sheets

SYSTEM FOR REMOTE CONTROL OPERATION OF HYDRANT

CROSS-REFERENCE TO RELATED APPLICATIONS

This application claims priority from U.S. Provisional Patent Application No. 63/497,397 filed on Apr. 20, 2023, which is incorporated by reference herein in its entirety.

BACKGROUND

Fire hydrants are a connection point by which firefighters can tap into a water supply. Due to the threat of fires in urban and suburban areas resulting from the concentration of people living and working in these areas, and the close proximity of structures, fire hydrants are a common and often required element in these areas.

Additionally, gatherings of people in urban and suburban areas may become violent, destructive, and generally disobedient to authorities when asked to disperse. One manner of actively and safely dispersing such a crowd is through the activation of fire hydrants in the area of the crowd, resulting in a large flow of water that is generally unpleasant to those in the area, and encouraging the people in the crowd to leave the area.

Gatherings of people in urban and suburban areas (whether at an organized event or incidental to the working and living of people in the area) may be a target for terrorism in the form of the intentional release of a biohazard or any airborne chemical hazard. Alternatively, the accidental release of a biohazard or any airborne chemical hazard may be particularly harmful in the aforementioned urban and suburban areas where the close proximity of people and congestion of roadways make it difficult to escape the environment quickly. One manner of slowing and mitigating the spread of a released biohazard or an airborne chemical hazard is through the activation of fire hydrants to put high levels of moisture into the ambient air resulting in reduced disbursement of the airborne threat.

However, current fire hydrant designs require a person with a specialized wrench to physically access each hydrant, one at a time, and turn each hydrant's operating nut to activate that hydrant and cause water to flow from it. This process is slow and perhaps impossible where crowds prevent the safe access of hydrants by the required personnel. What is needed is a system for remote control operation of a single hydrant or a group of hydrants as required.

SUMMARY

In one aspect, a system for remote control operation of a hydrant is provided, comprising: a hydrant, comprising: a barrel; a bonnet containing one or more outlet; a flange including a plurality of flange bolts; and an operating nut oriented at the top of the hydrant; and a remote system, comprising: a battery; a gearbox including an electric motor and an operating nut socket engaging the operating nut; a receiver/transmitter electrically connected to the battery and the electric motor; and at least one flange bolt engagement member engaging at least one flange bolt.

In another aspect, a system for remote control operation of a hydrant is provided, comprising: a hydrant, comprising: a barrel; a bonnet containing one or more outlet; a flange including a plurality of flange bolts; and an operating nut oriented at the top of the hydrant; and a remote system, comprising: a battery tray supporting a battery; a gearbox including an electric motor and an operating nut socket engaging the operating nut; a receiver/transmitter tray supporting a receiver/transmitter electrically connected to the battery and the electric motor; and at least one flange bolt engagement member engaging at least one flange bolt.

In another aspect, a system for remote control operation of a hydrant is provided, comprising: a hydrant, comprising: a barrel; a bonnet containing one or more outlet; a flange including a plurality of flange bolts; and an operating nut oriented at the top of the hydrant; and a remote system, comprising: a battery; a gearbox including an electric motor and an operating nut socket engaging the operating nut; and at least one flange bolt engagement member engaging at least one flange bolt.

BRIEF DESCRIPTION OF THE FIGURES

The accompanying figures, which are incorporated in and constitute a part of the specification, illustrate various example embodiments, and are used merely to illustrate various example embodiments. In the figures, like elements bear like reference numerals.

DETAILED DESCRIPTION

Figure 1A:
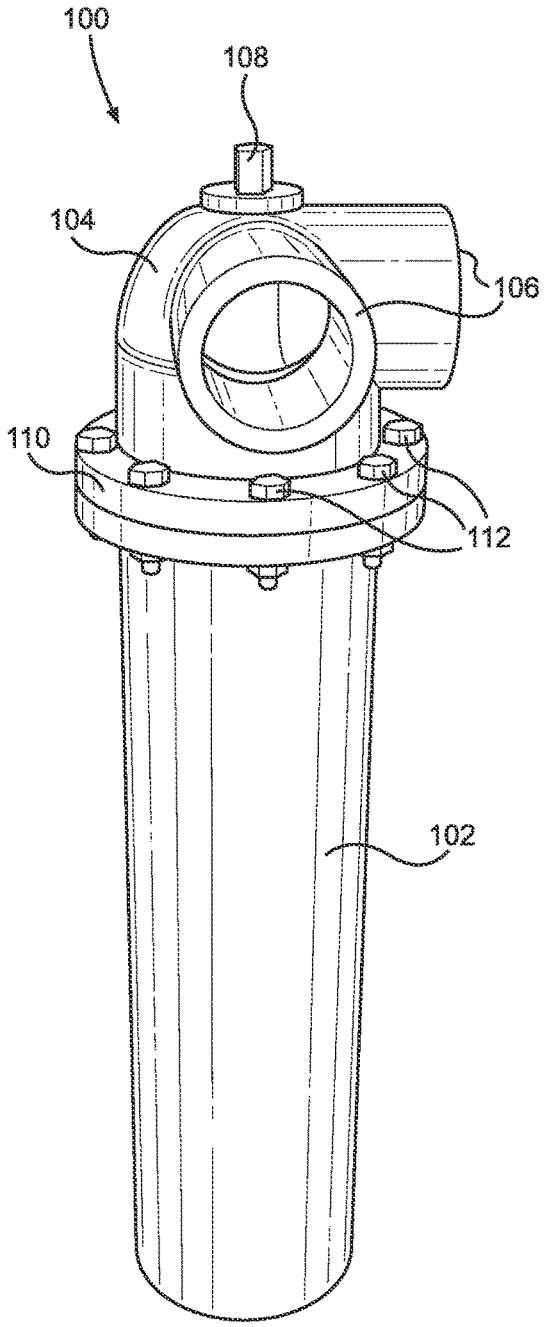
FIG. 1A illustrates a perspective view of a hydrant 100.
Figure 1B:
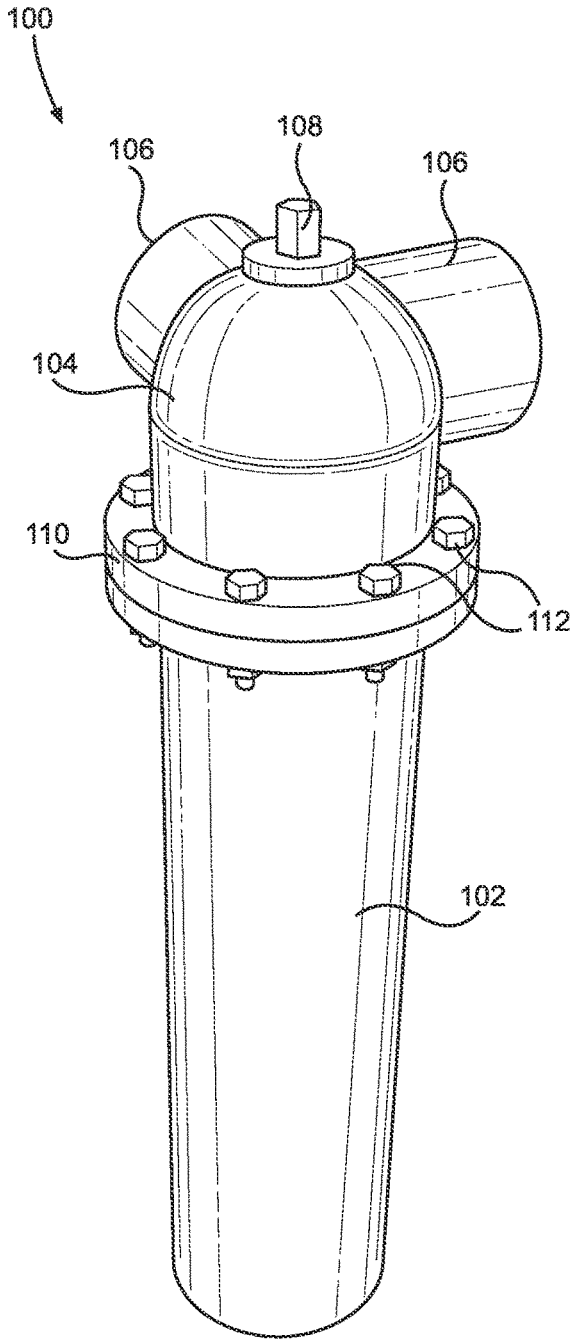
FIG. 1B illustrates a perspective view of hydrant 100.

FIGS. 1A and 1B illustrate a hydrant 100. Hydrant 100 includes a barrel 102 through which water flows, topped by a bonnet 104 containing one or more outlet 106 where water exits hydrant 100. Hydrant 100 is activated by an operating nut 108, which requires a tool (typically a specialized tool) to turn to open a valve (not shown) within barrel 102 resulting in the flow of water from outlet 106. Hydrant 100 may include a flange 110 secured by a plurality of flange bolts 112 oriented at points around the perimeter of flange 110. Flange 110 may secure bonnet 104 to barrel 102, with a top half of flange 110 being secured to bonnet 104 and a bottom half of flange 110 being secured to barrel 102. The top of hydrant 100, including the top half of flange 110, is that part that distal from a base of barrel 102, which is typically the ground, sidewalk, parking lot, roadway, or other surface upon which people walk, park, or drive.

Hydrant 100 is typically oriented vertically, with barrel 102 extending into the ground to connect to a pressurized water supply and operating nut 108 being oriented at the top of hydrant 100. Hydrants 100 in an urban or suburban area are typically arranged at prescribed distances from one another based upon the threat of fires in the area, population, government codes and legislation, or the like.

Figure 2A:
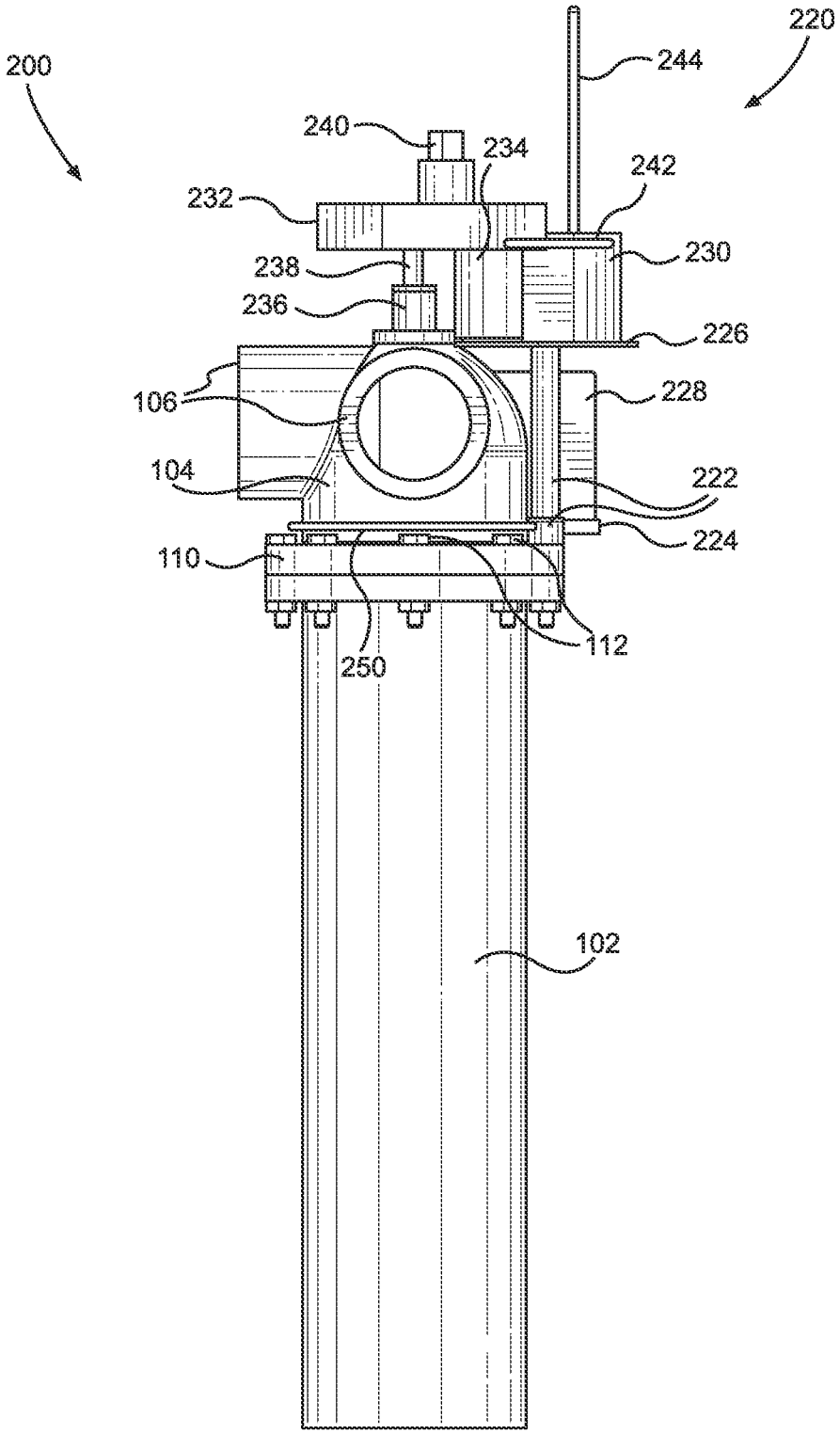
FIG. 2A illustrates an elevation view of a hydrant 200 fitted with a remote system 220 for remote control operation.
Figure 2B:
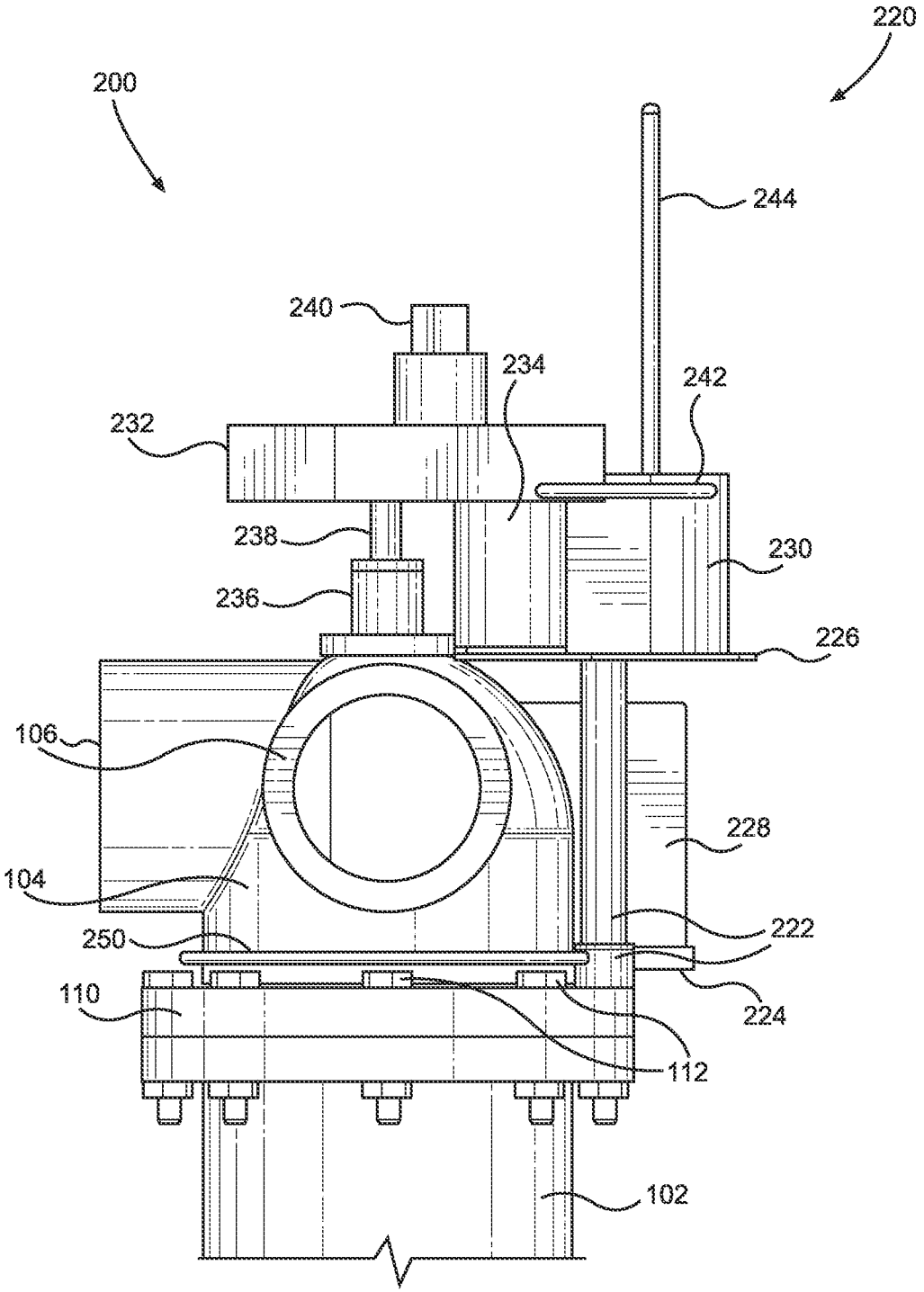
FIG. 2B illustrates a partial elevation view of hydrant 200 fitted with remote system 220 for remote control operation.
Figure 2C:
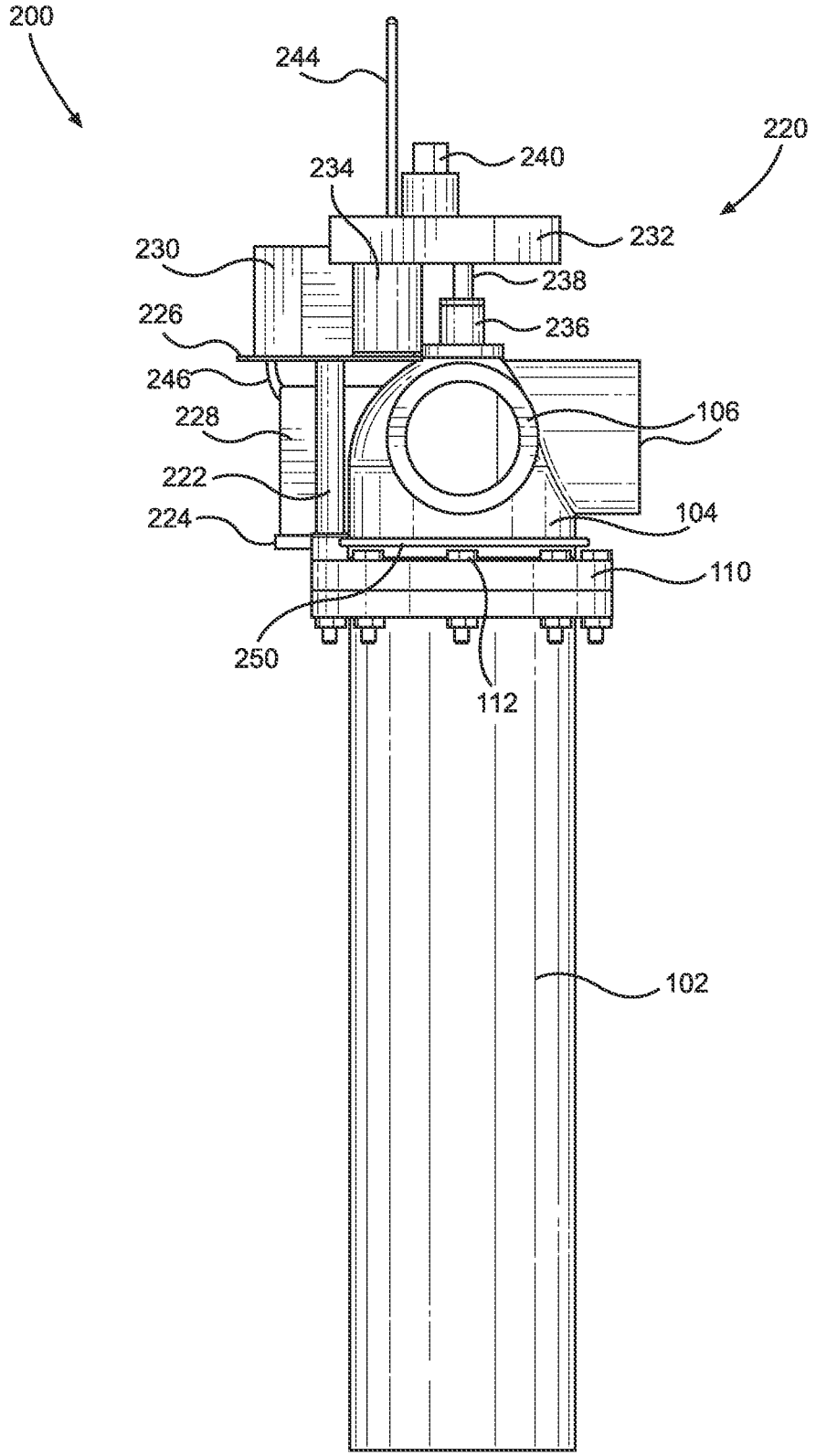
FIG. 2C illustrates an elevation view of hydrant 200 fitted with remote system 220 for remote control operation.
Figure 2D:
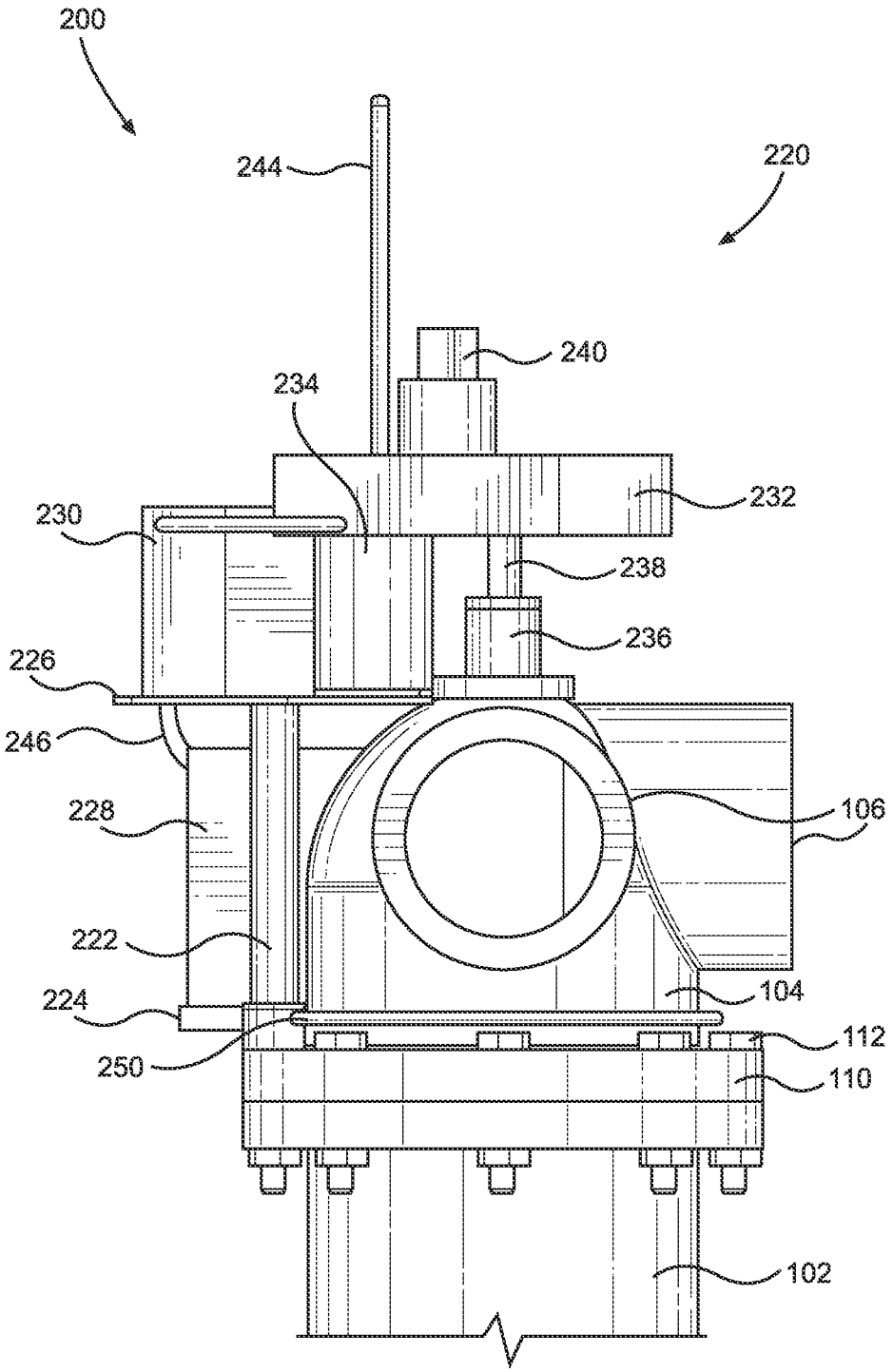
FIG. 2D illustrates a partial elevation view of hydrant 200 fitted with remote system 220 for remote control operation.
Figure 2E:
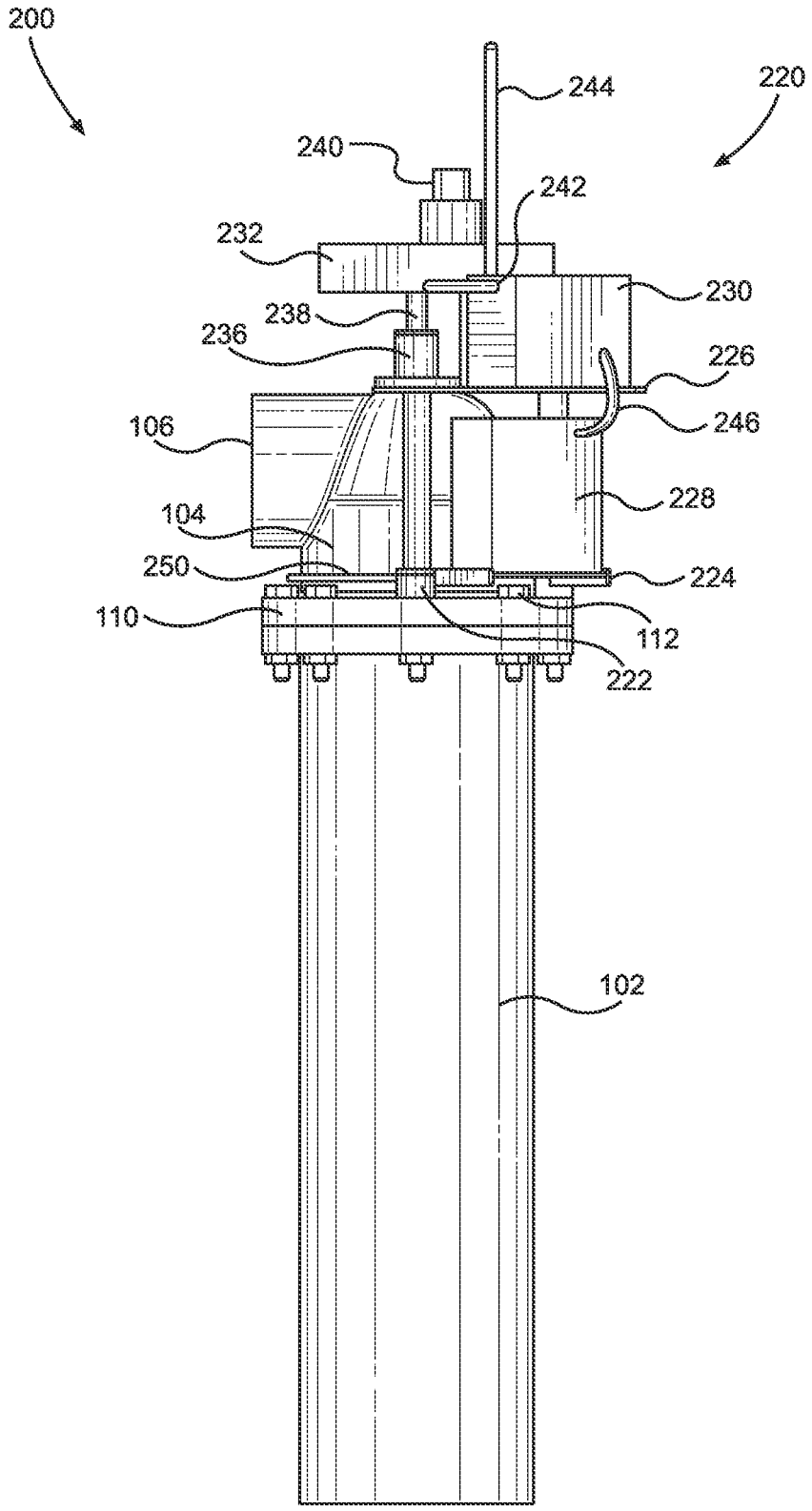
FIG. 2E illustrates an elevation view of hydrant 200 fitted with remote system 220 for remote control operation.
Figure 2F:
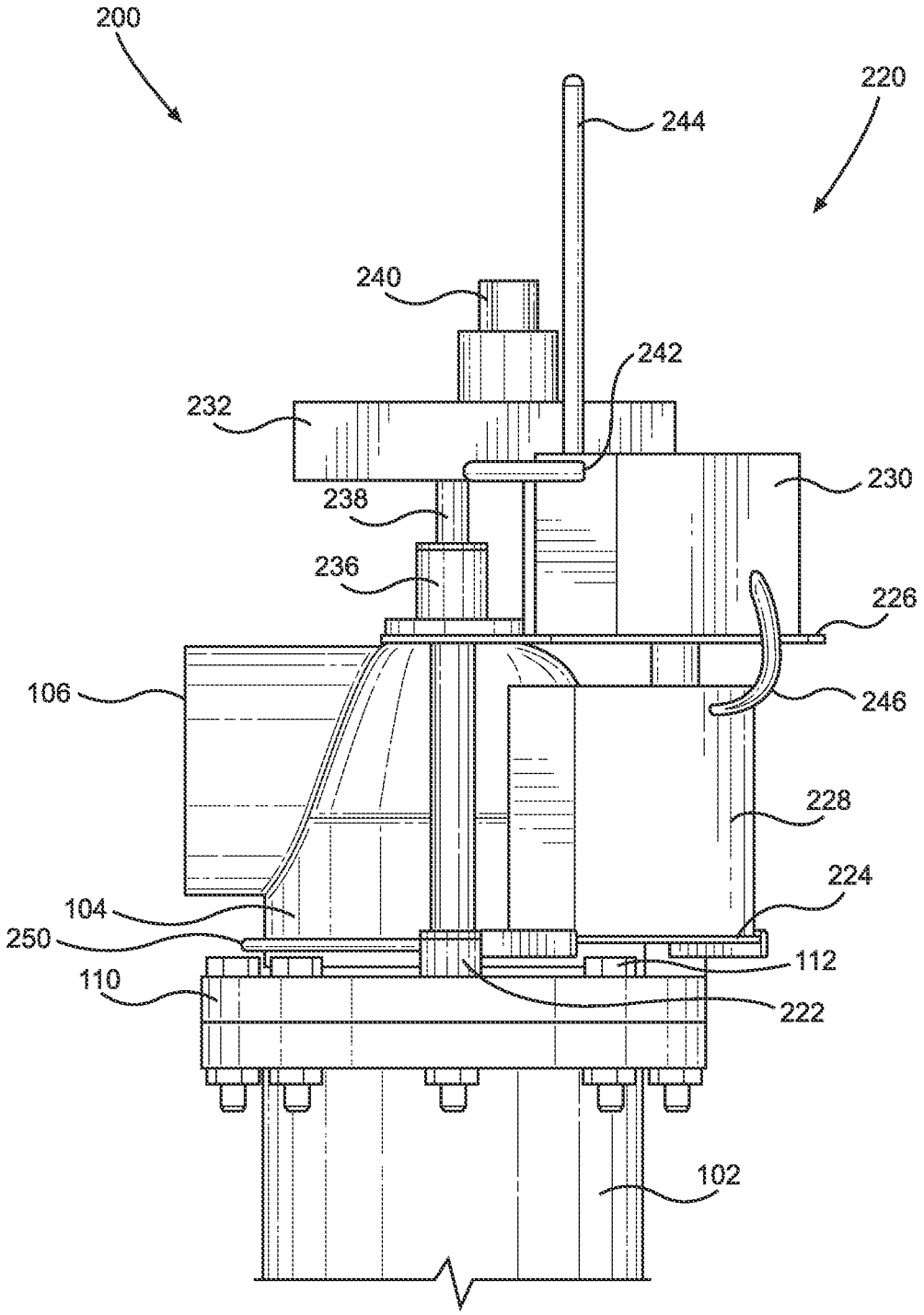
FIG. 2F illustrates a partial elevation view of hydrant 200 fitted with remote system 220 for remote control operation.
Figure 2G:
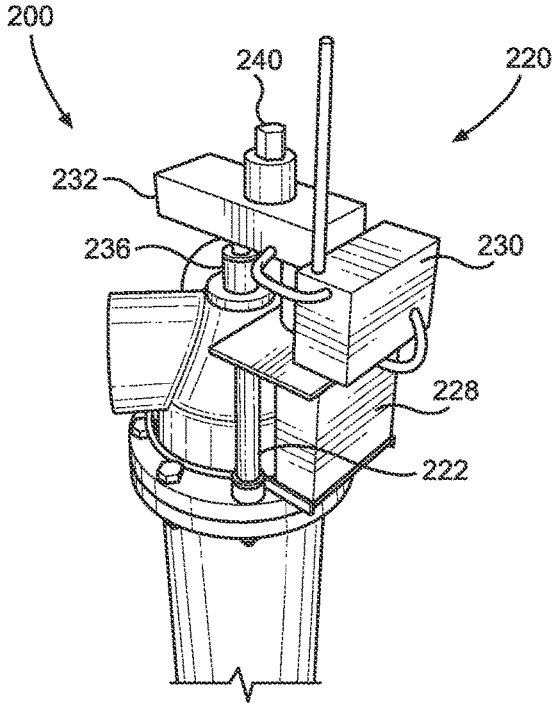
FIG. 2G illustrates a partial perspective view of hydrant 200 fitted with remote system 220 for remote control operation.
Figure 2H:
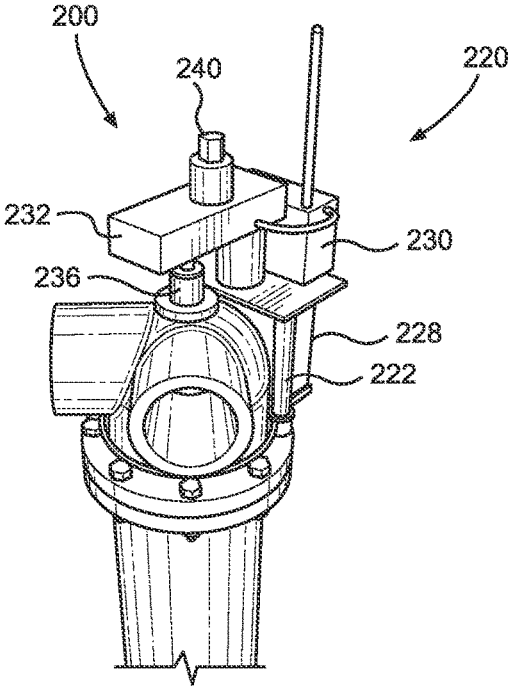
FIG. 2H illustrates a partial perspective view of hydrant 200 fitted with remote system 220 for remote control operation.
Figure 2I:
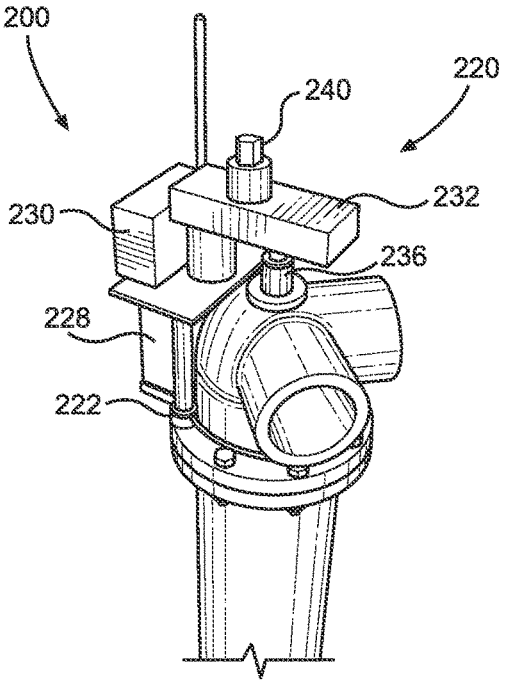
FIG. 2I illustrates a partial perspective view of hydrant 200 fitted with remote system 220 for remote control operation.
Figure 2J:
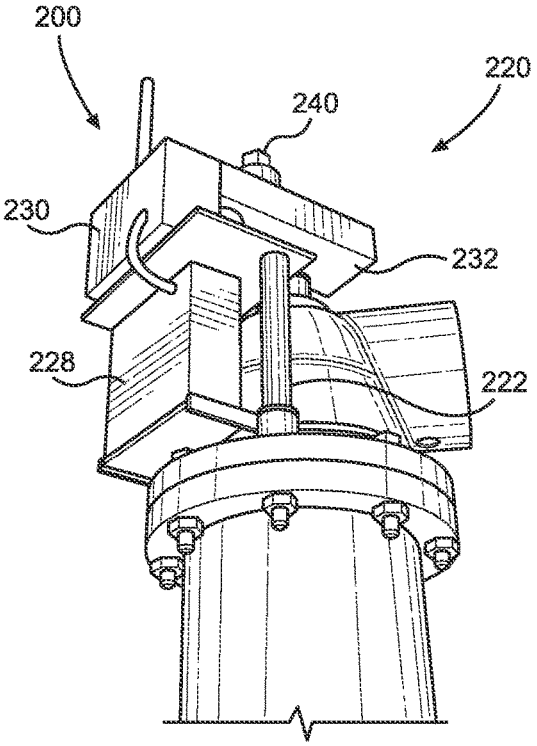
FIG. 2J illustrates a partial perspective view of hydrant 200 fitted with remote system 220 for remote control operation.
Figure 2L:
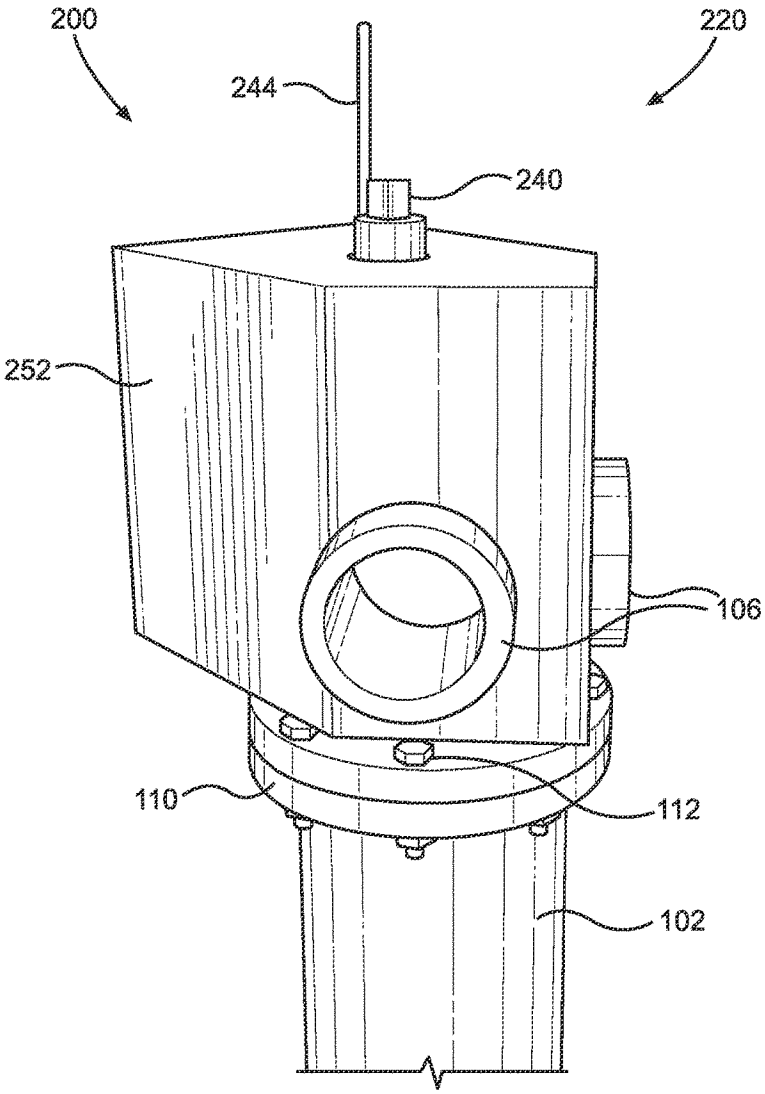
FIG. 2L illustrates a partial perspective view of hydrant 200 fitted with remote system 220 for remote control operation and cover 252.
Figure 2K:
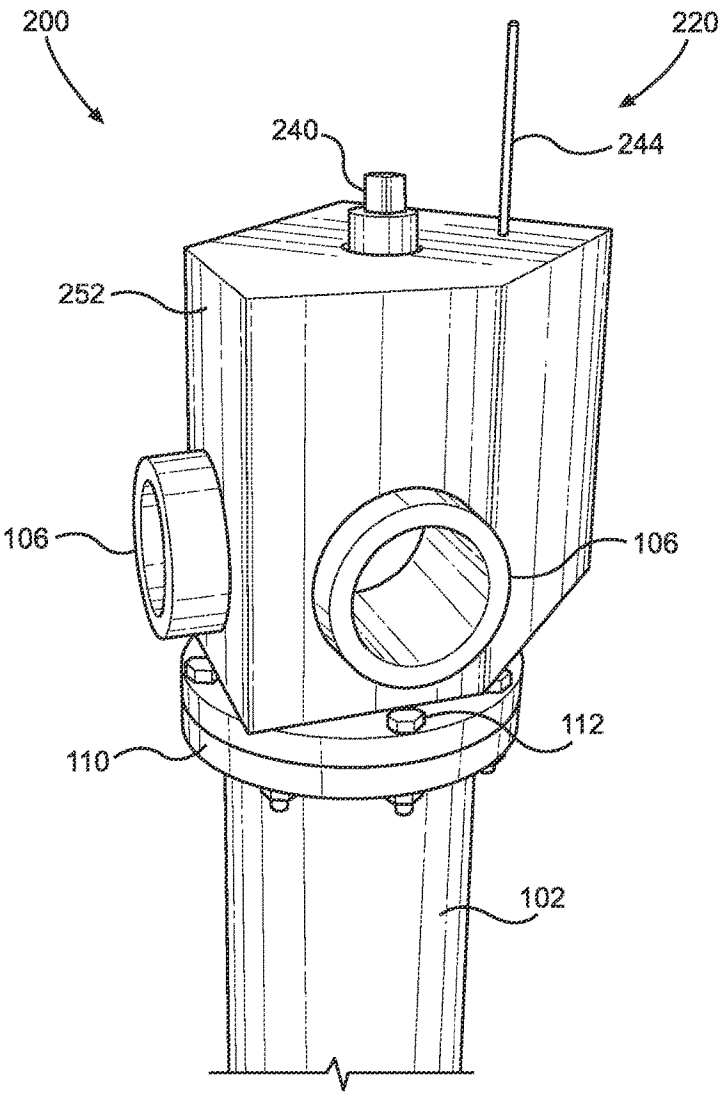
FIG. 2K illustrates a partial perspective view of hydrant 200 fitted with remote system 220 for remote control operation and a cover 252.
Figure 2N:
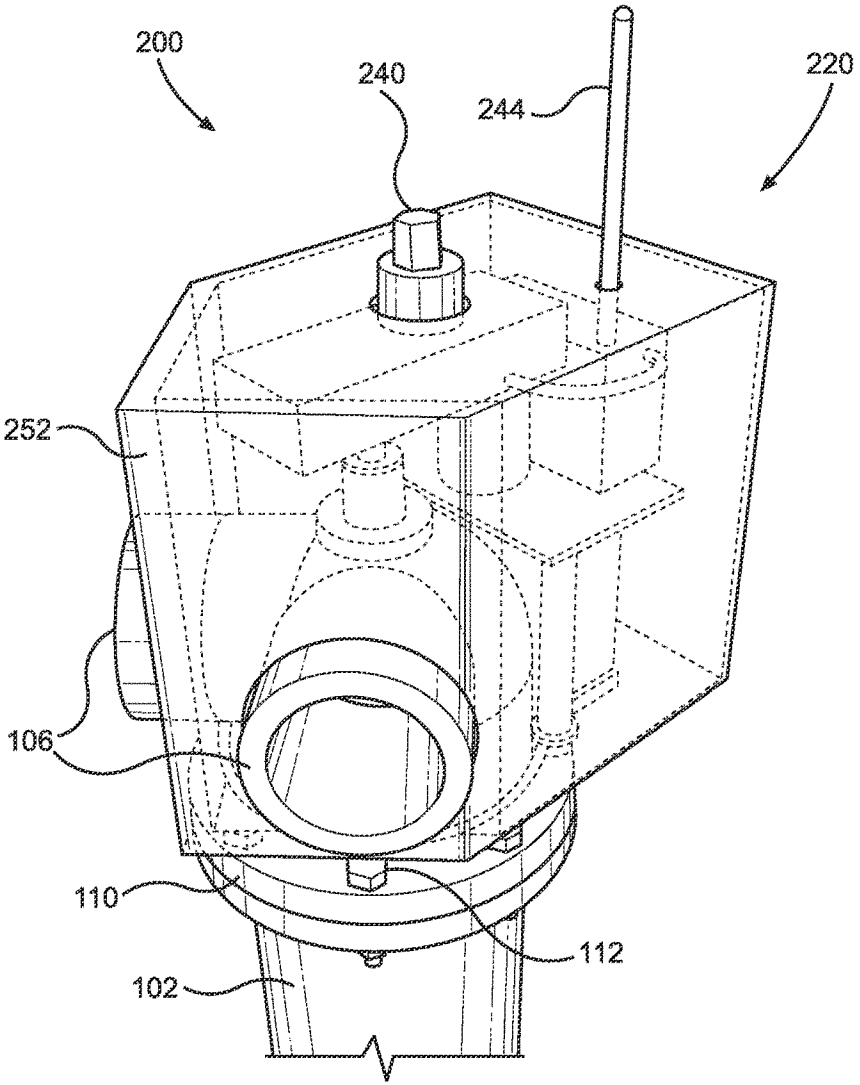
FIG. 2N illustrates a partial perspective view of hydrant 200 fitted with remote system 220 for remote control operation and cover 252.
Figure 2M:
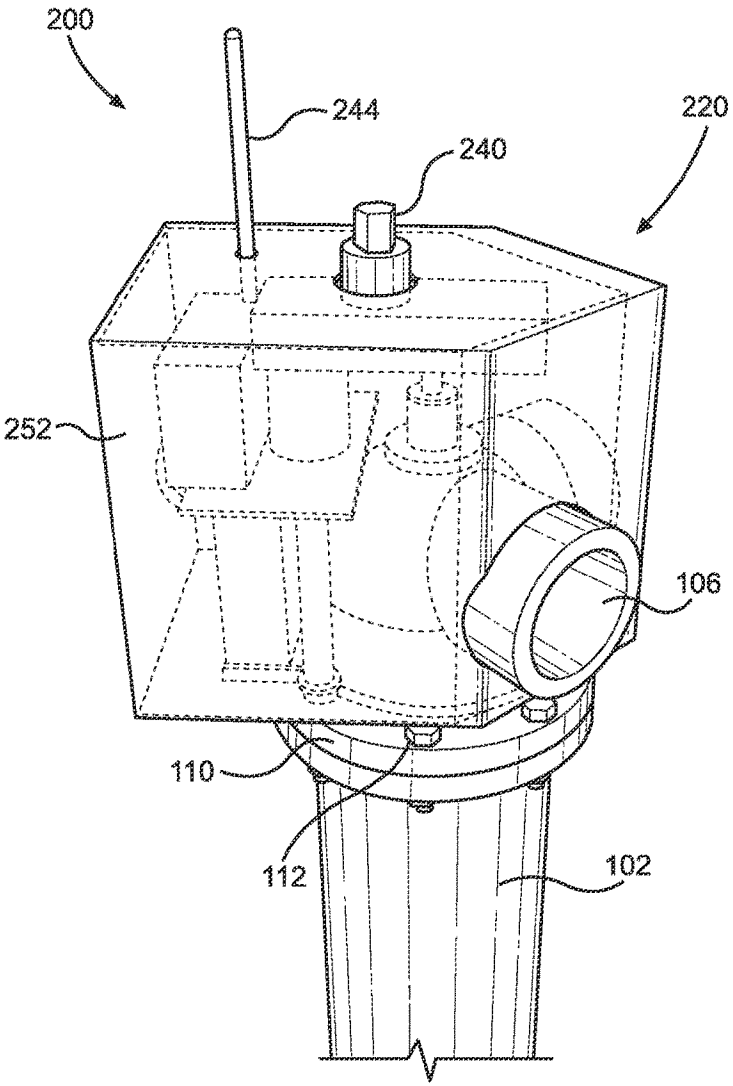
FIG. 2M illustrates a partial perspective view of hydrant 200 fitted with remote system 220 for remote control operation and cover 252.

FIGS. 2A-2N illustrate a hydrant 200 fitted with a remote system 220 for remote control operation. Hydrant 200 includes the same elements of hydrant 100 described above.

System 220 includes at least one flange bolt engagement member 222 for engaging at least one flange bolt (flange bolt 112). Member 222 may be part of a frame of system 220. Member 222 may at least partially secure system 220 to hydrant 200. Member 222 may prevent rotation of system 220 relative to hydrant 200. Member 222 may secure to the head of at least one flange bolt via a set screw or other fastener.

A battery tray 224 may be connected to at least one member 222. System 220 may include two members 222 and battery tray 224 may extend between and be connected to each of the two members 222. Battery tray 224 may support a battery 228, wherein battery 228 is configured to provide electrical energy to system 220. Battery tray 224 may be part of a frame of system 220. Battery tray 224 may support battery 228 including securing battery 228 to system 220.

A receiver/transmitter tray 226 may be connected to at least one member 222. System 220 may include two members 222 and receiver/transmitter tray 226 may extend between and be connected to each of the two members 222. Receiver/transmitter tray 226 may support a receiver/transmitter 230, wherein receiver/transmitter 230 is configured to control the activation of an electric motor 234 used to actuate an operating nut socket 236 as described below. Receiver/transmitter tray 226 may support receiver/transmitter 230 including securing receiver/transmitter 230 to system 220. Receiver/transmitter 230 may be capable of receiving and/or transmitting wireless electrical signals, including without limitation, UHF signals, VHF signals, HF signals, Bluetooth signals, Wi-Fi signals, and/or cellular signals. Electrical energy from battery 228 may power receiver/transmitter 230 via a battery cable 246 electrically connecting to each of battery 228 and receiver/transmitter 230. Receiver/transmitter 230 may include an antenna 244 for receiving and transmitting wireless signals. Receiver/transmitter 230 may be preprogrammed with command codes varying from 1-12 digit combinations of numerals. Alternatively, receiver/transmitter 230 may be replaced with a receiver 230, which is not capable of transmitting.

Alternatively, receiver/transmitter 230 may include a manual switch to allow a user to activate motor 234 to cause hydrant 200 to activate (begin flow of water) or deactivate (terminate flow of water). Alternatively, receiver/transmitter 230 may be replaced with a manual switch as described herein.

System 220 may include a gearbox 232 including a gear drive to transmit rotational energy from an electric motor to a socket shaft 238, which is directly connected to an operating nut socket 236. Gearbox 232 may include at least one gear. Gearbox 232 may include a plurality of gears. Socket 236 fits over and directly engages an operating nut (operating nut 108). Socket 236 may include a female cavity in the same shape and slightly larger dimensions as operating nut 108, to accommodate operating nut 108 such that socket 236 and operating nut 108 turn together. Gearbox 232 may include a torque sensor for measuring the torque in shaft 238 and/or socket 236.

Motor 234 may rotate upon the application of electricity from receiver/transmitter 230, via a power cable 242, where receiver/transmitter 230 receives a signal to activate or deactivate hydrant 200 and acts as a switch, allowing electricity from battery 228 to flow to motor 234. Motor 234 may turn a first direction when activating hydrant 200, and a second direction when deactivating hydrant 200. Motor 234 may be configured to operate in a first direction upon application of electricity with a first polarity, and in a second direction upon application of electricity with a second polarity.

Receiver/transmitter 230 may receive a preprogramed signal, which is interpreted in a microcontroller or microprocessor contained within receiver/transmitter 230 to cause motor 234 to operate in a desired direction via the relevant polarity. Receiver/transmitter 230 may transmit status of hydrant 200 (e.g., activated or deactivated) to a remote user. Receiver/transmitter 230 may transmit error messages where system 220 encounters an error, such as the inability to activate or deactivate hydrant 200. Receiver/transmitter 230 may transmit the status of battery 228. Receiver/transmitter 230 may transmit a tamper warning where an unauthorized individual attempts to activate or deactivate hydrant 200, damage hydrant 200, or otherwise render inoperable hydrant 200.

Upon receiver/transmitter 230 receiving an activation command, receiver/transmitter 230 allows electricity to flow from battery 228 to motor 234 with an "activation" polarity (that is, in a direction to activate hydrant 200) at its full torque for a predetermined number of revolutions of socket 236 (e.g., 8 revolutions of socket 236 (2,880 degrees of rotation)). Upon receiver/transmitter 230 receiving a deactivation command, receiver/transmitter 230 allows electricity to flow from battery 228 to motor 234 with a "deactivation" polarity (that is, in a direction to deactivate hydrant 200) until socket 236 experiences a predetermined torque value, at which point motor 234 is stopped, to ensure that hydrant 200 is not damaged.

System 220 may be configured to communicate with other systems 220 via receiver/transmitter 230. A user may activate or deactivate individual hydrants 200, or a group of hydrants 200, as necessary.

Where system 220 is used for crowd control, or biohazard/airborne hazard mitigation, users may preemptively place one or more system 220 on one or more hydrants 200 in specific areas prior to a planned gathering. For example, users may place one or more system 220 on one or more hydrants 200 in the vicinity of a sporting event, protest, political event, or the like, any of which may be the target of unruly crowds and/or hazards.

System 220 may include an auxiliary hydrant nut 240 connected to a shaft 238 and/or socket 236 to allow a user to override system 220 where necessary. For example, in the event of a fire, firefighters can override any input of system 220 to activate or deactivate hydrant 200 via auxiliary hydrant nut 240. Auxiliary hydrant nut 240 may be connected to a gear within gearbox 232. Auxiliary hydrant nut 240 is substantially the same size and shape as operating nut 108.

System 200 may include a security retainer 250 extending around the periphery of hydrant 200 in such a manner as to prevent unauthorized personnel from removing system 220 from hydrant 200. Security retainer 250 may be a chain, wire rope cable, or the like. Security retainer 250 may prevent system 220 from being removed from hydrant 200. Security retainer 250 may be connected at one or both ends to one or more of members 222 and battery tray 224.

FIGS. 2K-2N illustrate hydrant 200 including a cover 252. Cover 252 may be formed from any of a variety of materials, including a metal, an alloy, a polymer, a composite, and the like. Cover 252 may be formed from a solid material, such as sheet metal, or a perforated material, such as expanded metal. Cover 252 may include apertures for outlets 106, auxiliary hydrant nut 240, and/or antenna 244. Cover 252 may otherwise contain system 220. Cover 252 may be arranged to protect at least some components of system 220 from weather, UV light, tampering, vandalism, theft, unauthorized use, and the like. Cover 252 may include a bolt and padlock (not shown) to secure cover 252 in place.

Figure 3A:
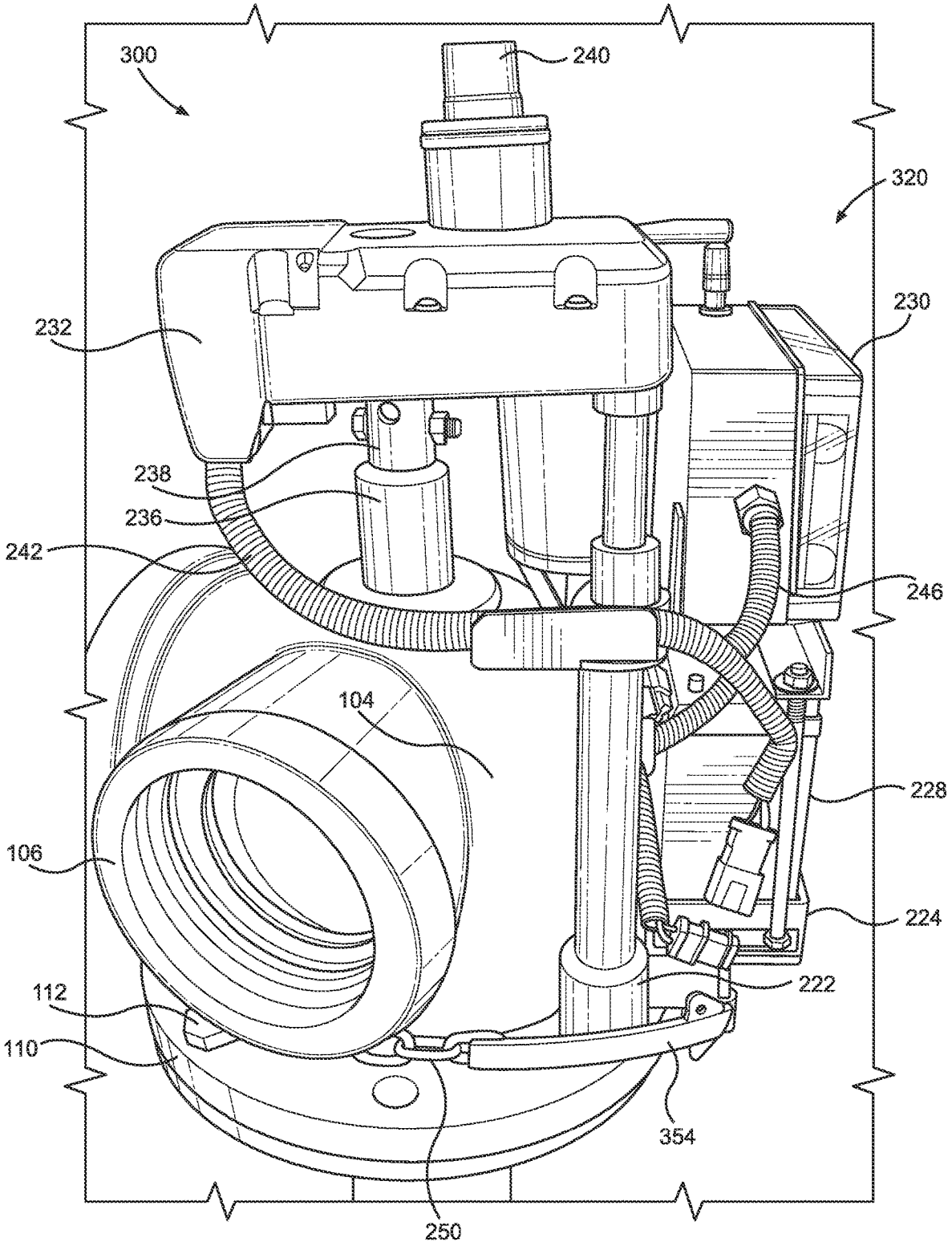
FIG. 3A illustrates a partial perspective view of a hydrant 300 fitted with remote system 320 for remote control operation.
Figure 3B:
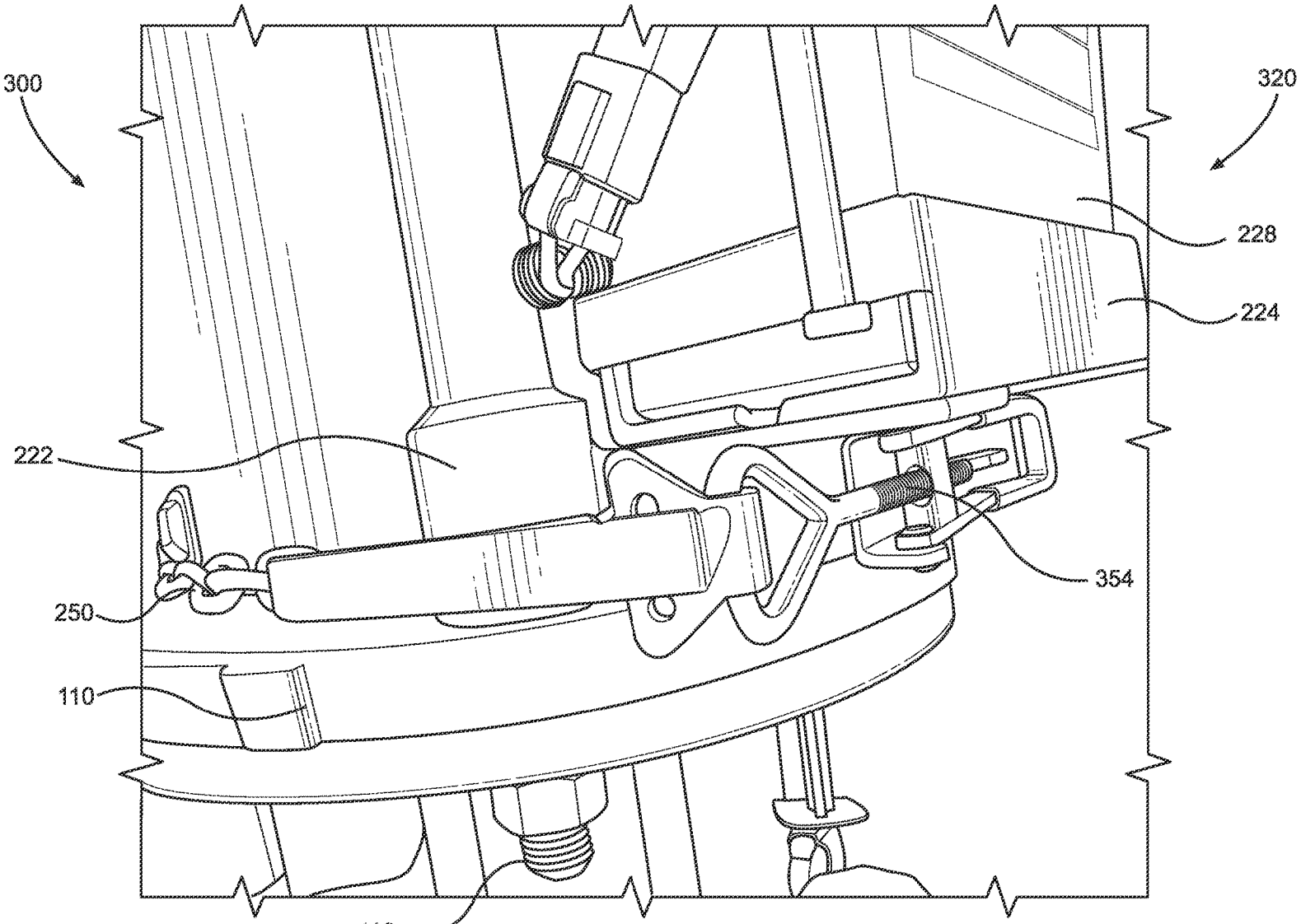
FIG. 3B illustrates a partial perspective view of hydrant 300 fitted with remote system 320 for remote control operation.
Figure 3C:
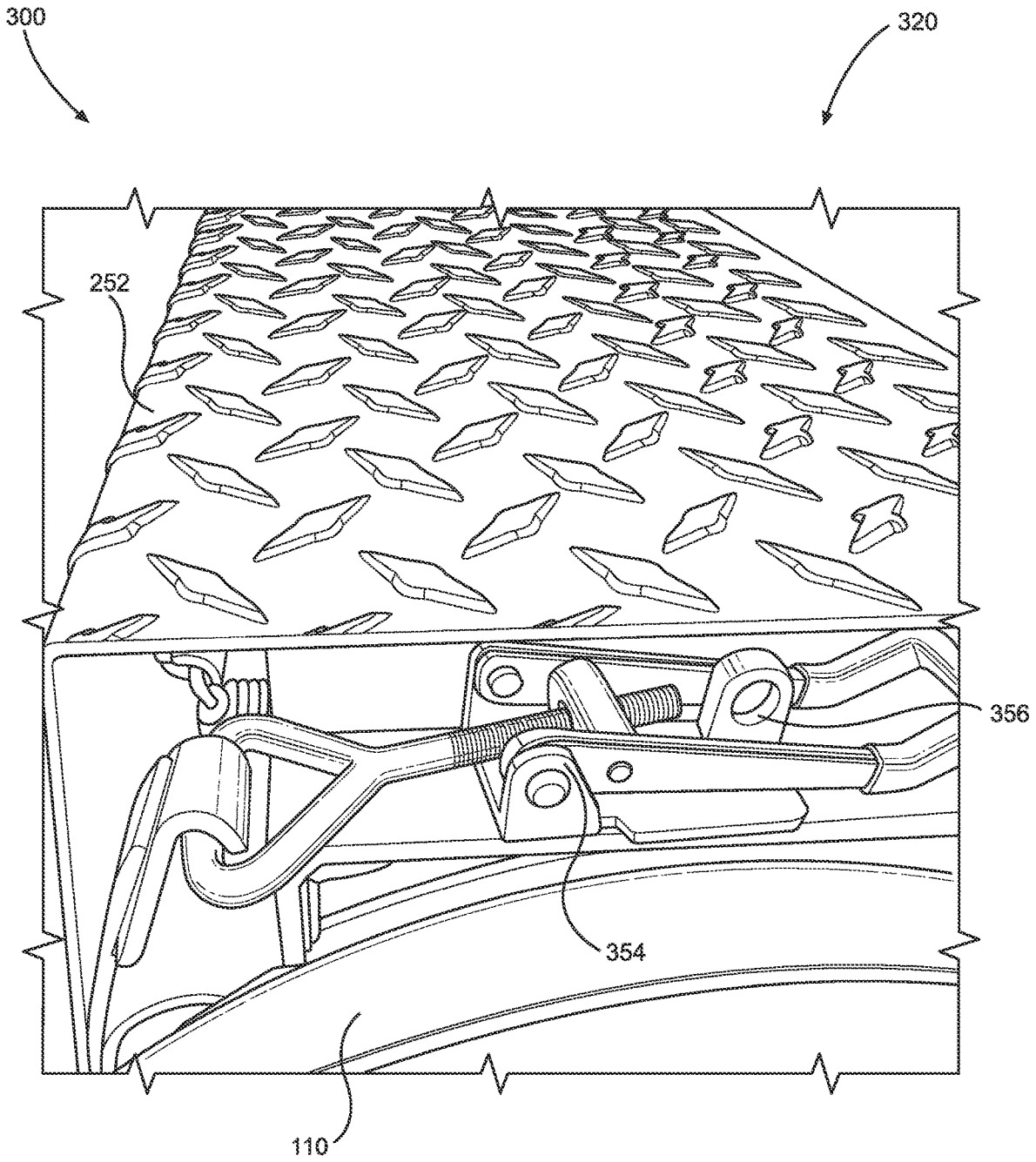
FIG. 3C illustrates a partial perspective view of hydrant 300 fitted with remote system 320 for remote control operation and cover 252.

FIGS. 3A-3C illustrates a hydrant 300 fitted with remote system 320 for remote control operation. System 320 includes an over center latch 354 to tension and secure security retainer 250. Over center latch 354 may be attached to one or both of flange bolt engagement member 222 and battery tray 224.

The combination of security retainer 250 and over center latch 354 may encircle bonnet 104, below outlets 106. The combination of security retainer 250 and over center latch 354 may encircle bonnet 104, below outlets 106, and over flange 110.

When installing system 320 on hydrant 300, one may disconnect security retainer 250 from one end of over center latch 354, extend security retainer 250 around bonnet 104 and under outlet(s) 106, and reconnect security retainer 250 to the end of over center latch 354. Over center latch 354 may be levered and closed, cinching security retainer 250 onto hydrant 300 so that it is secured. Optionally, a user may apply a lock, such as a padlock, in a lock aperture 356, which prevents opening of over center latch 354.

To the extent that the term "includes" or "including" is used in the specification or the claims, it is intended to be inclusive in a manner similar to the term "comprising" as that term is interpreted when employed as a transitional word in a claim. Furthermore, to the extent that the term "or" is employed (e.g., A or B) it is intended to mean "A or B or both." When the applicants intend to indicate "only A or B but not both" then the term "only A or B but not both" will be employed. Thus, use of the term "or" herein is the inclusive, and not the exclusive use. See Bryan A. Garner, A Dictionary of Modern Legal Usage 624 (2d. Ed. 1995). Also, to the extent that the terms "in" or "into" are used in the specification or the claims, it is intended to additionally mean "on" or "onto." To the extent that the term "substantially" is used in the specification or the claims, it is intended to take into consideration the degree of precision available or prudent in manufacturing. To the extent that the term "selectively" is used in the specification or the claims, it is intended to refer to a condition of a component wherein a user of the apparatus may activate or deactivate the feature or function of the component as is necessary or desired in use of the apparatus. To the extent that the term "operatively connected" is used in the specification or the claims, it is intended to mean that the identified components are connected in a way to perform a designated function. As used in the specification and the claims, the singular forms "a," "an," and "the" include the plural. Finally, where the term "about" is used in conjunction with a number, it is intended to include ±10% of the number. In other words, "about 10" may mean from 9 to 11.

As stated above, while the present application has been illustrated by the description of embodiments thereof, and while the embodiments have been described in considerable detail, it is not the intention of the applicants to restrict or in any way limit the scope of the appended claims to such detail. Additional advantages and modifications will readily appear to those skilled in the art, having the benefit of the present application. Therefore, the application, in its broader aspects, is not limited to the specific details, illustrative examples shown, or any apparatus referred to. Departures may be made from such details, examples, and apparatuses without departing from the spirit or scope of the general inventive concept.

The invention claimed is:

1. A system for remote control operation of a hydrant, comprising:
- a hydrant, comprising:
  - a barrel;
  - a bonnet containing one or more outlet;
  - a flange including a plurality of flange bolts; and
  - an operating nut oriented at the top of the hydrant; and
- a remote system, comprising:
  - a battery;
  - a gearbox including an electric motor and an operating nut socket engaging the operating nut;
  - further comprising an auxiliary hydrant nut connected to the operating nut socket engaging the operating nut; and
  - at least one flange bolt engagement member engaging at least one flange bolt.

2. The system of claim 1, further comprising a security retainer extending around at least a portion of the bonnet below the one or more outlet.

3. The system of claim 2, further comprising an over center latch attached to the security retainer.

4. The system of claim 1, further comprising a cover placed over the remote system, the cover including apertures for the one or more outlet.

5. The system of claim 1, wherein the at least one flange bolt engagement member prevents rotation of the remote system relative to the hydrant.

6. A system for remote control operation of a hydrant, comprising:
- a hydrant, comprising:
  - a barrel;
  - a bonnet containing one or more outlet;
  - a flange including a plurality of flange bolts; and
  - an operating nut oriented at the top of the hydrant; and
- a remote system, comprising:

a battery;

a gearbox including an electric motor and an operating nut socket engaging the operating nut;

at least one flange bolt engagement member engaging at least one flange bolt; and a cover placed over the remote system, the cover including apertures for the one or more outlet.

7. The system of claim 6, further comprising an auxiliary hydrant nut connected to the operating nut socket engaging the operating nut.

8. The system of claim 6, further comprising a security retainer extending around at least a portion of the bonnet below the one or more outlet.

9. The system of claim 8, further comprising an over center latch to attached to the security retainer.

10. The system of claim 6, wherein the at least one flange bolt engagement member prevents rotation of the remote system relative to the hydrant.

11. A system for remote control operation of a hydrant, comprising:

a hydrant, comprising:

a barrel;

a bonnet containing one or more outlet;

a flange including a plurality of flange bolts; and an operating nut oriented at the top of the hydrant; and a remote system, comprising:

a battery;

a gearbox including an electric motor and an operating nut socket engaging the operating nut; and at least one flange bolt engagement member engaging at least one flange bolt, wherein the at least one flange bolt engagement member prevents rotation of the remote system relative to the hydrant.

12. The system of claim 11, further comprising an auxiliary hydrant nut connected to the operating nut socket engaging the operating nut.

13. The system of claim 11, further comprising a security retainer extending around at least a portion of the bonnet below the one or more outlet.

14. The system of claim 13, further comprising an over center latch to attached to the security retainer.

15. The system of claim 11, further comprising a cover placed over the remote system, the cover including apertures for the one or more outlet.

* * * * *